US005501308A

United States Patent [19]

King

[11] Patent Number: 5,501,308

[45] Date of Patent: Mar. 26, 1996

[54] RETRACTABLE INCREMENTALLY ADJUSTING AUXILIARY LUGGAGE ATTACHMENT MECHANISM AND METHOD

[75] Inventor: William L. King, Denver, Colo.

[73] Assignee: Samsonite Corporation, Denver, Colo.

[21] Appl. No.: 182,495

[22] Filed: Jan. 18, 1994

[51] Int. Cl.[6] ..... A45C 5/14; A45C 13/30; A45C 13/38

[52] U.S. Cl. ..... 190/102; 190/18 A; 190/108; 190/15.1

[58] Field of Search ..... 190/27, 102, 15.1, 190/101, 8, 18 A

[56] References Cited

U.S. PATENT DOCUMENTS

| | | | |
|---|---|---|---|
| 672,173 | 4/1901 | LeFevre . | |
| 746,617 | 12/1903 | Wenzell | 190/102 |
| 910,288 | 1/1909 | Shaw . | |
| 1,081,657 | 12/1913 | Bray | 190/27 |
| 1,084,360 | 1/1914 | Rahm . | |
| 1,149,634 | 8/1915 | Crigler | 190/155 X |
| 1,158,841 | 11/1915 | Pingree | 190/27 |
| 1,916,793 | 7/1933 | Harper . | |
| 2,372,845 | 4/1945 | Nelson . | |
| 2,581,417 | 1/1952 | Jones . | |
| 2,707,035 | 4/1955 | Lashley . | |
| 3,564,590 | 2/1971 | Hebel . | |
| 3,606,372 | 9/1971 | Browning . | |
| 3,958,731 | 5/1976 | Riedle . | |
| 4,383,141 | 5/1983 | Walker . | |
| 4,621,404 | 11/1986 | Browning . | |
| 4,759,431 | 7/1988 | King et al. . | |
| 4,995,487 | 2/1991 | Plath . | |
| 5,108,119 | 4/1992 | Huang . | |
| 5,253,739 | 10/1993 | King . | |

FOREIGN PATENT DOCUMENTS

| | | | |
|---|---|---|---|
| 2441358 | 6/1980 | France . | |
| 327545 | 4/1930 | United Kingdom | 190/102 |
| 456956 | 11/1936 | United Kingdom | 190/102 |
| 785956 | 11/1957 | United Kingdom | 190/115 |
| WO93/19636 | 10/1993 | WIPO . | |

OTHER PUBLICATIONS

Advertisement—Leerblad, Sep. 1993, p. 96.

*Primary Examiner*—Sue A. Weaver
*Attorney, Agent, or Firm*—Lee R. Osman; Rod D. Baker

[57] ABSTRACT

A mechanism for attaching an auxiliary luggage case to a main luggage case including a cassette attached to the main luggage case, the cassette defining a elongated receptacle and a retention edge adjacent to the receptacle. The receptacle is adapted to receive the belt and the links connected to the belt when the belt and links are retracted to the main luggage case. An elongated flexible belt is attached at an inner end to the cassette, and has an attachment device connected to its outer end. A plurality of links are connected along the length of the belt. The belt is bent over the edge between the links to fix the position of the attachment device and the extension of the belt. The engagement of the edge with the link within the receptacle holds the belt and the attachment device in the position established by the selected location of the fold.

20 Claims, 3 Drawing Sheets

RETRACTABLE INCREMENTALLY ADJUSTING AUXILIARY LUGGAGE ATTACHMENT MECHANISM AND METHOD

This invention relates to attaching an auxiliary luggage case to a main luggage case, and more particularly to a new and improved incrementally adjusting auxiliary luggage case attachment mechanism and method using a link-segmented strap which may be employed independently of other apparatus and methodology for transporting the auxiliary luggage case on the main luggage case.

BACKGROUND OF THE INVENTION

Luggage, of the type adapted to contain articles of clothing, personal items and the like, has traditionally been transported by lifting the luggage using a carrying handle. More recently, however, particularly with larger pieces of luggage or those adapted to carry heavy articles, wheels have been mounted on the luggage, and an auxiliary handle or tether has been used to push or pull the luggage on its wheels. This type of wheeled luggage has met with considerable acceptance because greater weights can be transported with relative ease. To further take advantage of the conveniences of wheeled luggage, devices have been developed for attaching an auxiliary luggage case to the wheeled main luggage case to allow several luggage cases to be transported simultaneously.

Initially, the devices for carrying the auxiliary luggage case used fixed-length straps or expandable straps that were wrapped around the auxiliary luggage case as well as a portion of the wheeled luggage case to secure the two luggage cases together. These straps, however, were typically not connected to the wheeled luggage case. The potential for misplacing the strap, the inconvenience of having to separately store the strap, the risk of loss of the strap and the improper length of the strap to adequately attach the auxiliary luggage case were all factors which discouraged use of these separate straps.

Removable devices attached to the main luggage case, such as straps or hooks, have also been used for attaching auxiliary luggage cases to a main luggage case. However, removable devices have also failed to satisfy users. Storing the removable device in the main luggage case was an inconvenience because the device consumed valuable packing space and was sometimes difficult to access when the main case was packed. Removing the device and storing it elsewhere created an inconvenience because access to it was limited, and the device could easily be misplaced.

Devices permanently attached to a main luggage case for carrying auxiliary luggage have also presented issues of convenient use. When the permanent attachment devices are not being used to attach an auxiliary luggage case, they often project from the case and pose the risk of becoming broken, snagged or otherwise caught on other articles. The permanent nature of the attachment devices on the main luggage case can also make the case difficult to store.

Efforts to devise a wheeled main luggage case with the ability to carry an auxiliary luggage case have resulted in attachment devices that depend from an extendable pull handle on the main luggage case. An example of one of these devices is disclosed in U.S. Pat. No. 4,759,431, assigned to the assignee hereof. These devices are retractable in conjunction with the retraction of the handle, so an auxiliary luggage case is intended to be attached and carried when the pull handle is extended from the main luggage case. Under some circumstances it may be desirable not to extend the pull handle or to roll the main luggage case on its wheels in order to use the auxiliary luggage attaching capability.

An difficulty common to many of the attachment devices described above relates to the adjustment of the attachment device to accommodate different-sized auxiliary luggage cases. Typically, where the attachment device includes a strap or a strap with a hook, the length of the strap must be adjusted. Adjusting the strap often requires manipulation of the strap and a clasp or buckle device. The degree of manipulation required often makes it very difficult for the user to accomplish in a convenient manner, particularly if the user is wearing gloves or is carrying other articles.

Attachment devices using hooks attached to the exterior of the main luggage case do not provide any adjustment for accommodating the varying sizes of auxiliary luggage cases. Because the hook is not adjustable, the auxiliary luggage case is often attached to the main luggage case in a position not optimal for balance and convenient transportation.

Another inconvenience common to many of the previous attachment devices relates to storing the device when it is not in use. Often times the attachment device must be removed, folded or otherwise manipulated in an inconvenient manner before being stored. Any difficulty in storing the attachment device detracts from its overall utility.

It is with respect to these considerations and other background information relative to prior art auxiliary luggage attachment mechanisms that the significant improvements of the present invention have evolved.

SUMMARY OF THE INVENTION

One of the important aspects of the present invention relates to an auxiliary luggage case attachment mechanism which is permanently attached to a main luggage case to avoid problems of misplacing or losing it, which is retractable when not in use to avoid problems of inconvenience, breakage, exposure and the like, which is extendable to the selected degree desirable to accommodate a variety of different types and sizes of auxiliary luggage, which is conveniently and quickly positioned and retained in a multiplicity of selected positions which is functional independently of the other functionability of the main luggage case, and which avoids the necessity to use pull handles and the like in order to utilize the auxiliary case carrying capability.

These and other aspects are achieved by a new and improved mechanism and method for attaching an auxiliary luggage case to a main luggage case. A cassette is attached to the main luggage case and the cassette defines an elongated receptacle and a retention edge adjacent to the receptacle. An elongated flexible belt having an auxiliary luggage case attachment device is connected to an outer end of the belt, and a plurality of substantially abutting link members are connected along the length of the belt. A stop link member is connected to an inner end of the belt, and the cassette retains the stop link member within the receptacle to prevent removal of the stop link member from the receptacle. The receptacle is adapted to receive the belt and the links connected to the belt when the belt and links are retracted to the main luggage case.

The belt is bent over the retention edge at a selected location between the intermediate adjacent links to fix the position of the attachment device and the extension of the belt. The engagement of the edge with the link within the receptacle establishes a restraining force which is transmitted through the links to the outer end of the belt to hold the belt and the attachment device in the position established by the selected location of the fold.

The links are preferably rectangularly shaped with a front side and a back side, and each has a pair of opposing longitudinal sides, a pair of transverse ends, and a plate extending between the longitudinal sides. The plate extends short of the transverse ends and forms a slot adjacent to each transverse end. The belt is threaded onto each link, passing from the back side to the front side through the slot adjacent to one transverse ends, over the front side of the plate, and through the slot adjacent to the other one of the transverse ends from the front side to the back side.

Upon bending the belt in a direction toward the front side of the links, the transverse ends engage one another and prevents the belt from substantially bending in the forward direction. Upon bending the belt in a direction toward the back side of the plurality of links, the transverse ends move away from one another and the belt incrementally bends at locations between the transverse ends.

The attachment device is preferably a hook, having a front side and a back side corresponding to the front side and back side of the plurality of links. The hook has a base end, similar to the transverse ends of the links, and an extended end integrally formed together in a J-shape. The base end is operably connected to the belt.

The attachment mechanism securely attaches an auxiliary luggage case to the main luggage case. The attachment mechanism is self storing when not in use, and thus alleviates the problems of the attachment mechanism becoming caught on another item, being damaged by another item, or damaging other items. The attachment mechanism is permanently secured to the main case, alleviating the problem of misplacing the attachment mechanism. The attachment mechanism is incrementally adjustable to easily accommodate the size of the auxiliary luggage case.

A more complete appreciation of the present invention and its scope can be obtained from the accompanying drawings, which are briefly summarized below, the following detailed description of presently preferred embodiments of the invention, and the appended claims.

DETAILED DESCRIPTION

Figure 1:
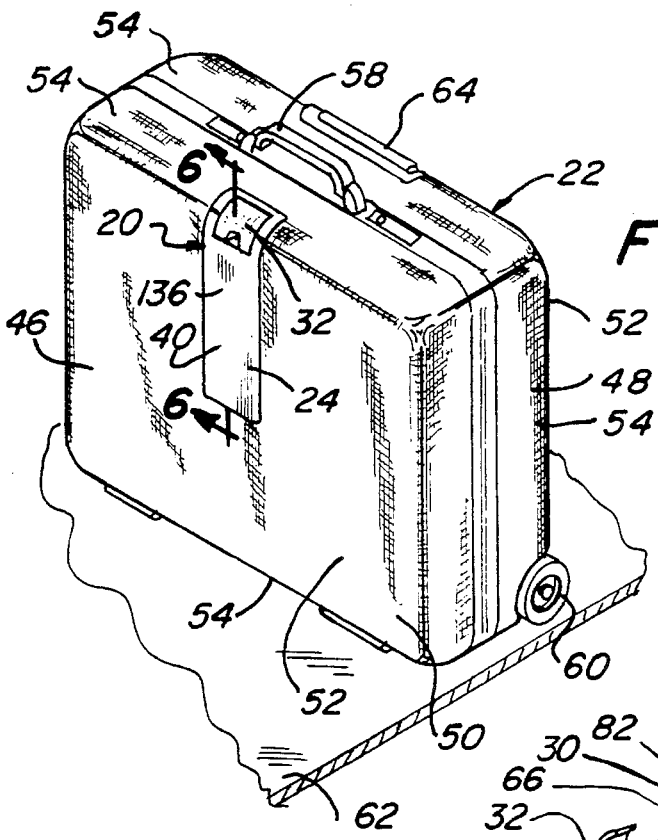
FIG. 1 is a front perspective view of a wheeled luggage case having an auxiliary case attachment mechanism incorporating the present invention, shown with the attachment mechanism in a position of non-use.
Figure 2:
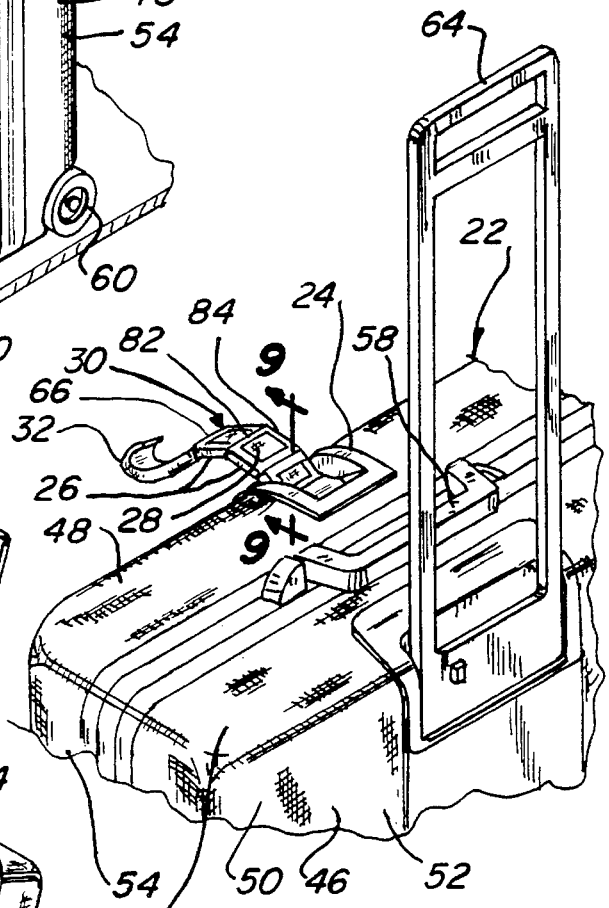
FIG. 2 is an enlarged rear partial perspective view of the wheeled luggage case as shown in FIG. 1, illustrating a link-segmented belt and a hook in an extended position but not holding an auxiliary luggage case.
Figure 3:
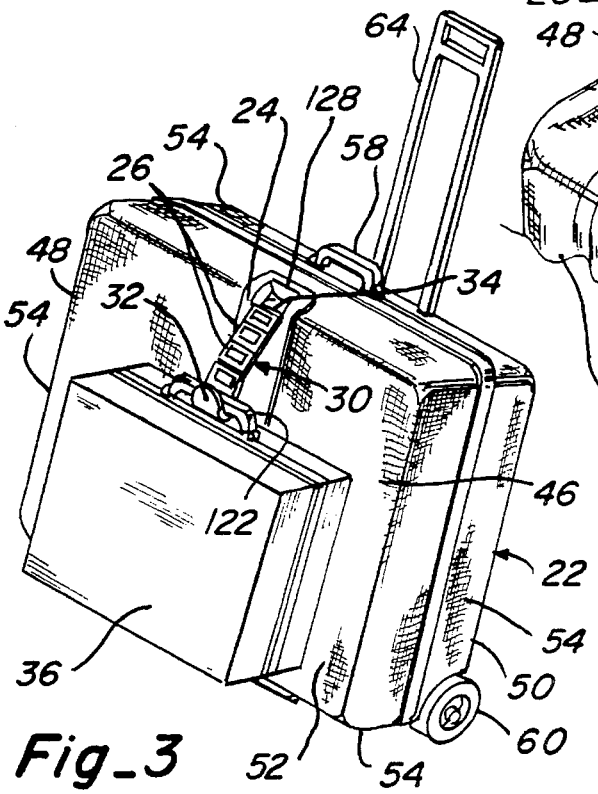
FIG. 3 is a front perspective view of the wheeled luggage case shown in FIGS. 1 and 2, illustrating use of the attachment mechanism to support an auxiliary luggage case.

An auxiliary luggage case attachment mechanism 20, which embodies one form of the present invention, is connected to a main luggage case 22 as shown in FIGS. 1–3. The attachment mechanism 20 includes a cassette 24, a plurality of links 26 which are connected together by a flexible belt 28 to form a link-segmented strap 30, and a hook 32. The hook 32 and the links 26 along the belt 28 are operably extendable from and retractable into a receptacle 34 of the cassette 24.

When an auxiliary luggage case 36 is not attached to the main luggage case 22, the link-segmented strap 30 and the hook occupy a retracted position shown in FIG. 1. In the retracted position, the hook 32 covers the cassette receptacle 34, facilitating convenient storage of the hook 32 and eliminating the necessity of having a separate cover for closing the receptacle 34. An exterior surface 38 of the hook 32 is flush with an exterior surface 40 of the cassette 24 in the retracted position.

In the extended position, the link-segmented strap 30 and hook 32 extend from the cassette receptacle 34 to carry an auxiliary luggage case 36. When extended, the links 26 allow incremental adjustment of the strap 30 to a suitable and selected length which positions the hook 32 at the best position selected by the user for attaching a variety of sizes and shapes of auxiliary luggage cases 36 to the main luggage case 22.

Figure 4:
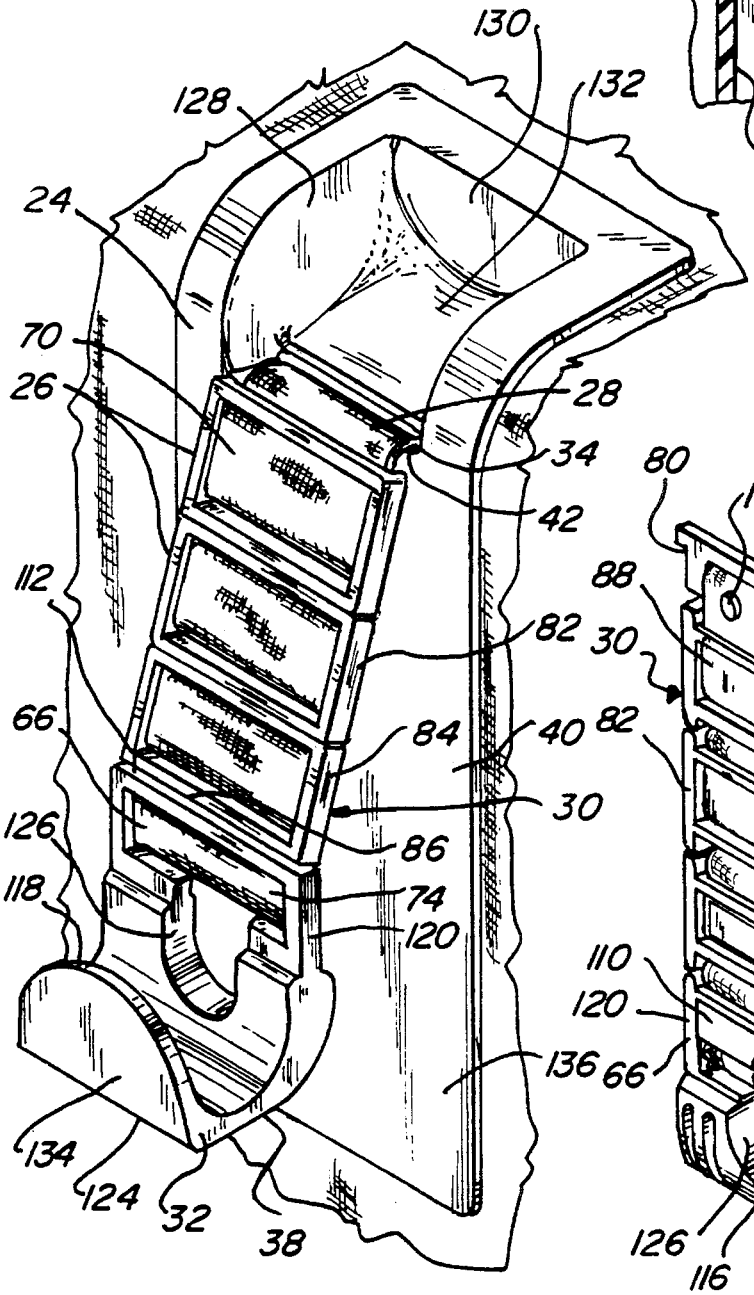
FIG. 4 is an enlarged perspective view of the attachment mechanism showing the link-segmented strap and hook in an extended position from a cassette, similar to that view shown in FIG. 2.
Figure 8:
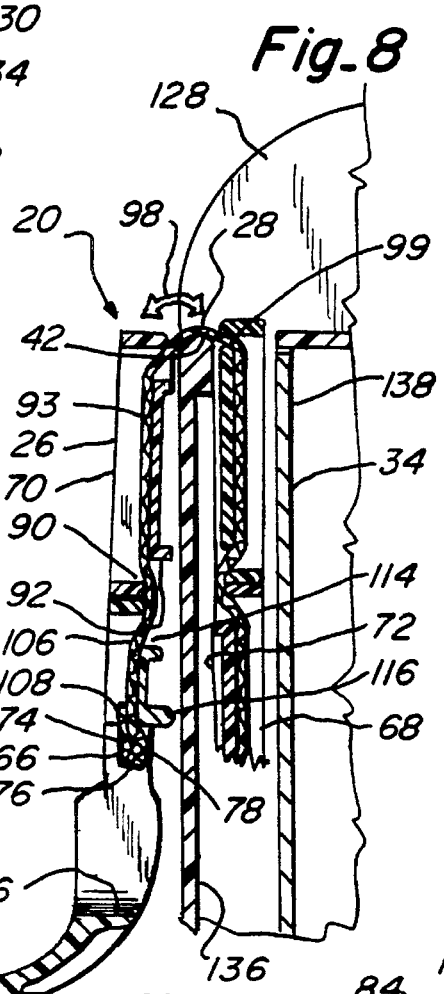
FIG. 8 is a partial section view similar to FIG. 6 but illustrating the adjustment of the link-segmented strap and hook.

To adjust the length of extension, the segmented strap 30 folds between two links 26 over a front outer edge 42 of the cassette 24, as shown in FIGS. 4 and 8. The links 26 are positioned end-to-end essentially along the entire length of the belt 28 with enough space to allow the belt 28 to fold between the links 26. The links 26 are confined between the hook 32 and a second or inner end 44 of the belt 28, so the positions between the links define finite incremental positions to which the segmented strap 30 can be extended. Because the fold in the belt 28 at the edge 42 is fixed in a relative incremental position along the segmented strap 30 by the position of the links 26 and the link contact of a link with the edge 42 at the fold in the belt 28, the link-segmented strap 30 is held in the selected position to which it is adjusted by the position of the fold.

The luggage case 22 may be a conventional hard-sided suitcase having a main body 46 formed from two similar component shells 48 and 50, as shown in FIG. 1. Each shell 48 and 50 has a large side face panel 52 and four perpendicular edge panels 54. A hinge (not shown) extending along the lower edge panels pivotably connects the shell 48 and 50 to form the main body 46. A carrying handle 58 is attached to one shell half 48 or 50 at a centrally located position on a top edge panel 54 so that the luggage case can be carried in a conventional manner.

A pair of roller wheels 60 are rotatably mounted at the bottom of one of the side face panels 52. The wheels 60 engage a support surface 62 to allow the luggage case 22 to be rolled rather than carried, at the user's option. A maneuvering handle 64 is selectively extendable from, and retractable into, the interior of the case 22 at a side face panel 52 as shown in FIGS. 1, 2 and 3. The handle 64, when extended, is used for pulling or maneuvering the luggage case 22 on the wheels 60. The handle 64 is retractable when the luggage case is not being maneuvered on the wheels by the user.

Details of the link-segmented strap 30 and hook 32 are shown in FIGS. 4–9. The link-segment strap 30 has a first front end 66 attached to the hook 32, a second rear end 68 connected to luggage case 22. The rear end 68 of the strap is operably connected within the receptacle 34 of the cassette 24. The link-segmented strap 30 extends from and retracts into the cassette receptacle 34 in an extended elongated configuration without being folded or rolled up. In the fully retracted position, the entire segmented strap 30 is located within the receptacle. In the extended position, substantially all of the strap extends from the receptacle 34.

The belt 28 is preferably bendable or foldable and is substantially non-expandable in length. The belt is preferably made of fabric material and has a flat front side 70 and a flat back side 72. A front end 74 of the belt is sewn in a loop 76 surrounding an attachment pin 78 of the hook 32. The rear end 44 of the belt 28 is operably attached to a stop link 80.

The links 26 are threaded along the belt 28 between the hook 32 and the stop link 80. Each link 26 is able to move only slightly longitudinally along the belt, because the links are restrained by the hook 32 at one end and the stop link 80 at the other end. Each link 26 is formed substantially as a rectangular frame 82. The link frame 82 has a pair of opposing longitudinal sides 84 and a pair of transverse ends 86.

A plate 88 extends transversely between the two longitudinal sides 84 but extends longitudinally short of the two transverse ends 86 to leave gaps or slots 90 between the plate 88 and the two transverse ends 86. The thickness (the dimension perpendicular to the longitudinal and transverse dimensions) of the transverse ends 86 is somewhat less than the thickness of the longitudinal sides 84, leaving a clearance space 92 in the thickness at the transverse ends 86 at the slots 90. When the plurality of links 26 are threaded onto the belt 28, each of the transverse ends 86 of each link 26 abuts the transverse end 86 of an adjacent link.

Each link 26 is threaded onto the belt 28 at one longitudinal end by extending the belt through the clearance space 92, through the slot 90 at the one end of the link, over the outward facing surface 93 of the plate 88, through the slot 90 at the other end of the link and through the clearance space 92 at the other end of the link. The thickness of the clearance space 92 is sufficient to accommodate the thickness of the belt 28. All of the links 26 are threaded onto the belt in a similar manner. An identification label 94 may be placed conveniently between the sides 84 and ends 86 above the belt 28 and plate 88 of one of the links.

The links 26 on the belt 28 act to cause the link-segmented strap 30 to resist deflection outwardly as indicated by arrow 96 (FIG. 8) and allowing the link-segmented strap 30 to bend only backwards between the links 26 as indicated by arrow 98 (FIG. 8). When the link-segmented strap 30 is attempted to be bent forward in the direction of arrow 96, the transverse ends of the adjacent links 26 engage one another and prevent further bending because there is very little clearance between the links along the belt 28. Consequently, the links prevent the link-segmented strap 30 from bending substantially outward (in direction of arrow 96). However, the links 26 allow the belt to bend in the reverse direction or outward (shown by arrow 98) because the transverse ends 86 do not contact one another when bent in the reverse direction, thereby allowing the link-segmented strap 30 to bend at the incremental positions between the links 26. When bending in the reverse direction, extra clearance between the links 26 is achieved by the fact that the pivoting occurs at longitudinally facing transverse edges 99 (FIG. 8) of the plates 88. The extra length of the belt through the slots 90 and through the clearance space 92 provides the necessary length for bending in the reverse direction.

Figure 9:
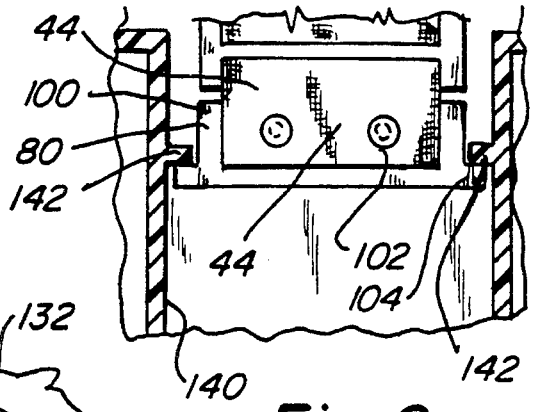
FIG. 9 is a vertical plane section view of the link-segmented strap at its extreme extended position, taken substantially in the plane of line 9—9 of FIG. 2.
Figure 5:
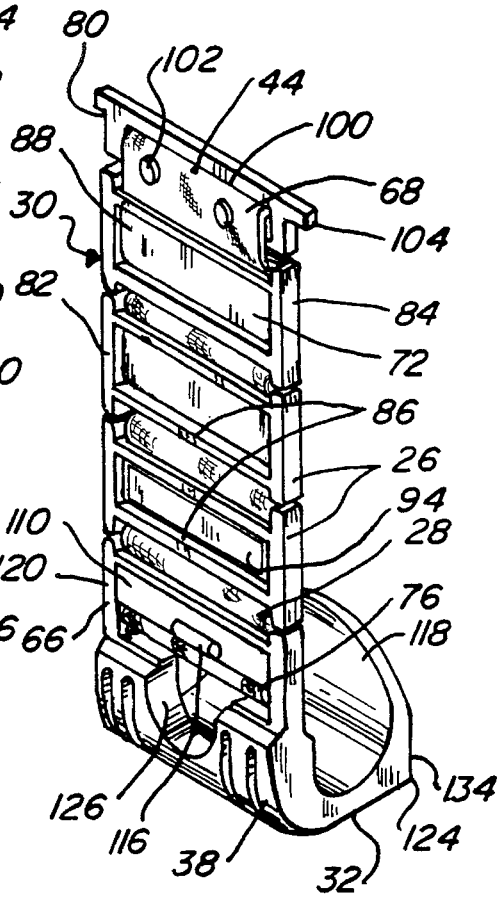
FIG. 5 is a perspective view from the rear of the link-segmented strap and hook as shown in FIG. 4, separate from the cassette.
Figure 6:
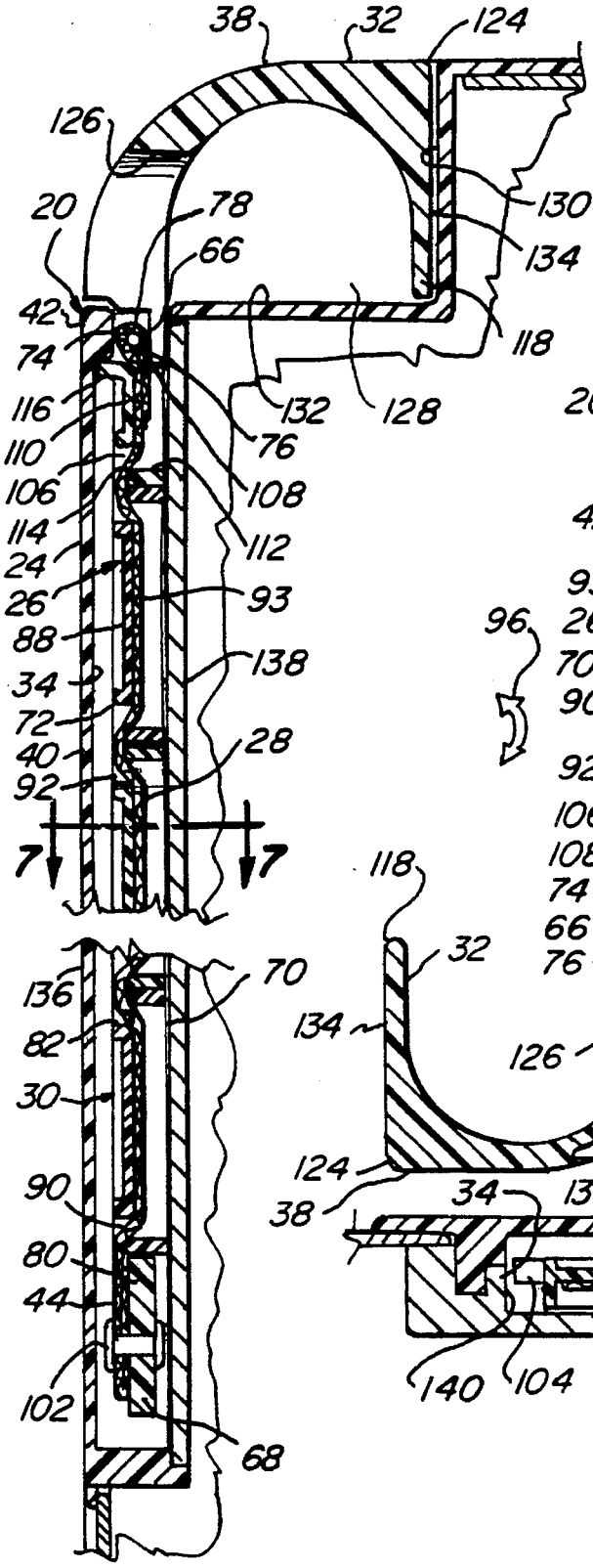
FIG. 6 is an enlarged section view of the attachment mechanism with the link-segmented strap and hook in a retracted position, taken substantially in the plane of line 6—6 of FIG. 1.

The stop link 80 has a main body portion 100 to which the inner end 44 of the belt 28 is operably attached by a suitable fastener, for instance rivets 102, as shown in FIGS. 5, 6 and 9. A pair of laterally opposing tabs 104 extend transversely outwardly away from the main body portion 100 of the stop link 80. The tabs 104 engage the cassette receptacle 34 when the strap 30 is extended therefrom the maximum amount to keep the strap from exiting the cassette receptacle 34, as shown in FIG. 9.

The hook 32, which is attached to the first end 74 of the belt 28, is preferably formed in a general rigid J-shape, as shown in FIGS. 4, 5, 6 and 8. Two slots 106 and 108 are formed in the hook at the location where it connects to the belt. The slots 106 and 108 extend transversely and are located on opposite sides of a shelf 110. A transverse end 112 of the hook is similar to the transverse ends 86 of the links 26, and also provides a clearance space 114. The belt is threaded through the clearance space 114, the slot 106, over the shelf 110, into the slot 108 where the loop 76 formed in the belt surrounds the attachment pin 78. The pin 78 is inserted into the loop 76. The pin 78 has a diameter larger than the width of the slot 108. The size of the loop 76 and the pin prevent the belt end 44 from sliding through the slot 108, thus anchoring the belt 28 to the hook.

A tab 116 is formed on the back side of the hook 32 and acts as a detent to secure the link-segmented strap 30 in the retracted position, as shown in FIG. 6. The tab 116 creates a friction or restraining force against the cassette 24 when the hook is in the retracted position in the receptacle 34.

An extended end 118 of the hook curves to an ending position substantially parallel to a base end 120 of the hook, as shown in FIGS. 4, 5, 6 and 8. The extended end 118 also tapers or is rounded in the traverse dimension, as shown in FIG. 4, to facilitate placement of an auxiliary luggage handle 122 (FIG. 3) over the hook. A square outer corner 124 is formed on the hook 32 which smoothly initiates the exterior surface 38 of the hook in the retracted position to the shape of the cassette 24. A hole 126 is formed through the base end 120 of the hook for grasping to extract the link-segmented strap 30 from the cassette receptacle 34.

The cassette 24 is located in or adjacent to one large face panel 52 of the case 22, as shown in FIGS. 1 and 3. The cassette 24 is located near the intersection of the top edge of the side face panel 52 and the top edge panel 54. This position is advantageous for carrying and supporting the auxiliary luggage case 36.

A recessed area 128 is formed in the cassette receptacle 34 to receive the hook 32 in the retracted position, as shown in FIGS. 3, 4, 6 and 8. The recessed area 128 has a back wall 130 and a shallow arcuate shaped bottom wall 132. When the hook 32 is placed within the recessed area 128, a flat surface 134 of the hook 32 fits adjacent to the back wall 130 and the exterior surface 38 of the hook 32 is flush with the outer surface 40 of the cassette 24.

Figure 7:
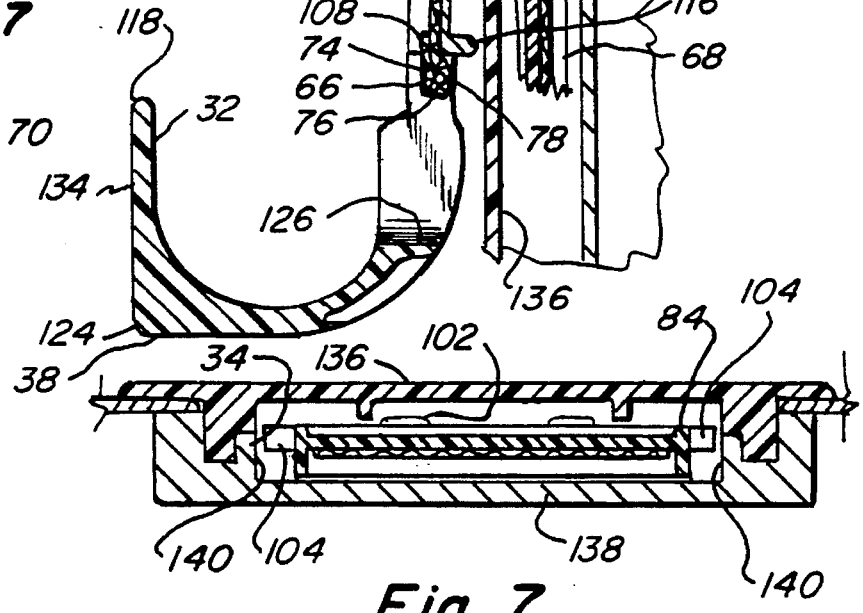
FIG. 7 is a section view taken substantially in the plane of line 7—7 of FIG. 6.

The cassette receptacle 34 extends downward from the recessed area 128 within the luggage case 22. The cassette receptacle 34 includes a front wall 136, a rear wall 138, and two opposing side walls 140, as shown in FIGS. 6 and 7. The two opposing side walls 140 are separated by a dimension greater than the transverse dimension of the stop link 80 between the tabs 104, as seen in FIG. 7. The opposing side walls 140 restrain the lateral movement of the link-segmented strap 30. The dimension of the receptacle 34 between the opposing front and rear walls 136 and 138 is greater than the thickness-dimension of the links 26. With these dimensions, the link-segmented strap 30 can easily be moved and guided along the length of the receptacle 34.

The edge 42 of the cassette receptacle 34 is formed by the front wall 136, as shown in FIGS. 6 and 8. In the extended position, as shown in FIG. 8, the link-segmented strap 30 is bent over the edge 42 at the point of adjacency between two links 26. The links separate when bent over the edge 42 and the exterior links hang adjacent to the front wall 136. The belt 28 folds between the links 26 at the edge 42, and the links along the belt between both ends of the belt prevent the belt from slipping around the edge 42, as shown in FIG. 8. Because of the front and rear walls 136 and 138 of the receptacle, the link 26 inside the receptacle cannot pivot around the edge, thus holding the link-segmented strap 30 in position. The front and back walls 136 and 138 of the receptacle 34 maintain the stop link 80 and the other links 26 within the receptacle 34 to maintain the fold of the belt 28 in the single location at the edge.

When the hook 32 and segmented strap 30 are pulled out of the receptacle 34 a maximum distance, the tabs 104 on the stop link 80 engage shoulders 142 of the cassette 24 near the receptacle 34 and keep the segmented strap 30 from being completely removed from the receptacle, as shown in FIG. 9.

The interaction between the edge 42 and the segmented strap 30 allows the height of the hook 32 to be adjusted easily. To adjust the hook 32, the link-segmented strap 30 is substantially straightened and then moved into or out of the cassette receptacle 34, as shown in FIG. 2. At the appropriate length, the link-segmented strap 30 is bent over the edge 42 between two links 26, as shown in FIGS. 4 and 8. The carrying handle 122 of the auxiliary luggage case 36 is then placed over the hook.

To store the attachment mechanism 20 when not in use, the segmented strap 30 is lifted up substantially straight in line with the receptacle 34 and then lowered into the receptacle. The hook 32 is placed in the recessed area 128 with the flat surface 134 of the extended end 118 of the hook 32 adjacent to the back wall 130, as shown in FIG. 6.

The attachment mechanism 20 is capable of being used with a hard-sided luggage case without wheel capability or an extendable handle. Additionally, with appropriate attachment of the cassette 24, the attachment mechanism 20 is capable of being used with a soft-sided luggage case, or as an add-on feature to an existing hard or soft-sided luggage case.

Numerous advantages accrue as a result of using the attachment mechanism of the present invention. The problems associated with using straps or hooks separate from the wheeled luggage case, straps or hooks permanently attached to the exterior of the wheeled luggage case, or straps or hooks releasably attached to the exterior of the wheeled luggage case are eliminated. The attachment mechanism 20 is not able to be misplaced. The attachment mechanism 20 will not catch on other articles when not in use, and does not take up a large amount of space when stored.

In addition, the link-segmented strap 30 and hook 32 are easily adjusted for carrying many sizes or configurations of auxiliary luggage cases 36. The links 26 threaded onto the belt 28 provide the belt with rigidity. The rigidity allows the segmented strap 30 to easily be extended from and retracted into the cassette receptacle 34, as well as incrementally adjusted while extended. Many other significant advantages and improvements are apparent after comprehending the improved features of the present invention.

A presently preferred embodiment of the present invention and many of its improvements have been described with a degree of particularity. The previous description is a preferred example for implementing the invention, and the scope of the invention should not necessarily be limited by this description. The scope of the present invention is defined by the scope of the following claims.

The invention claimed is:

1. An attachment mechanism adapted to attach an auxiliary luggage case to a main luggage case, comprising:

a cassette attached to the main luggage case, the cassette defining an elongated receptacle and a retention edge adjacent to the receptacle;

an elongated flexible belt;

an auxiliary luggage case attachment device connected to an outer end of the elongated belt;

a plurality of link members connected to the belt, one of the link members being a stop link member connected to an inner end of the elongated belt, the other ones of the link members being intermediate link members positioned in substantially abutting relationship with one another along the length of the belt between the attachment device and the stop link member;

the elongated receptacle having a length adapted to receive the belt and the link members connected to the belt;

means for retaining the stop link member within the receptacle to prevent removal of the stop link member from the receptacle and to allow movement of the stop link member along the length of the receptacle;

the belt and the intermediate link members being selectively extendable and retractable between a fully extended position outside the receptacle and a fully retracted position within the receptacle;

adjacent intermediate link members being separated by a distance sufficient to allow a portion of the flexible belt between the adjacent intermediate link members to contact the retention edge while one of the adjacent intermediate link members extends outside of the receptacle and the other one of the adjacent intermediate link members is retracted within the receptacle;

the cassette including a restraint structure adjacent to the receptacle and the retention edge to restrain the other one of the adjacent intermediate link members within the receptacle and establish a partially extended position of the belt and the intermediate link members outside the receptacle once the portion of the belt contacts the retention edge; and the restraint structure and the retention edge supporting the weight of the auxiliary luggage case once the auxiliary luggage case is attached to the attachment device at the outer end of the belt.

2. An attachment mechanism as defined in claim 1 wherein:

the intermediate link members are rectangularly shaped with a front side and a back side;

each intermediate link member includes a pair of opposing longitudinal sides, a pair of transverse ends, and a plate extending between the longitudinal sides;

the plate extends short of the transverse ends and defines a slot adjacent to each transverse end, each slot having a width dimension sufficient to receive an end of the belt;

each intermediate link member is threaded onto the belt by the belt passing through the slot adjacent to one of the transverse ends, over the plate, and through the slot adjacent to the other one of the transverse ends; and each intermediate link member substantially abuts an adjacent link member along each of the transverse ends.

3. An attachment mechanism as defined in claim 2 wherein:

the transverse ends have a thickness less than a thickness of the longitudinal sides leaving a clearance space adjacent to each transverse end; and each intermediate link member is threaded onto the belt by the belt passing through the clearance space and the slot adjacent to one of the transverse ends, over the plate, and through the clearance space and the slot adjacent to the other one of the transverse ends.

4. An attachment mechanism as defined in claim 3 wherein:

the transverse ends of the intermediate link members engage one another upon bending the belt in a direction toward the front sides of the intermediate link members to prevent the belt from substantially bending in the forward direction.

5. An attachment mechanism as defined in claim 3 wherein:

the transverse ends of adjacent intermediate link members move away from one another to allow the belt to bend at incremental locations between the transverse ends of the adjacent intermediate link members when the belt bends in a direction toward the back sides of the intermediate link members.

6. An attachment mechanism as defined in claim 5 wherein:

the cassette has an exterior wall common with a front wall of the receptacle;

the belt bends over the retention edge at locations between the transverse ends when the belt is extended outside the receptacle;

the outer end of the belt hangs adjacent to the exterior wall of the cassette when the belt is extended outside the receptacle; and the inner end of the belt is restrained inside the receptacle.

7. An attachment mechanism as defined in claim 6 wherein the means for retaining the stop link member within the receptacle comprises:

a pair of laterally opposing outwardly extending tabs on the stop link member; and a pair of laterally opposing inwardly extending shoulders within the receptacle, said shoulders engaging the tabs to restrain the stop link member within the receptacle when the belt and the intermediate link members are fully extended outside the receptacle.

8. An attachment mechanism as defined in claim 2 wherein:

the attachment device includes a hook having a front side and a back side.

9. An attachment mechanism as defined in claim 8 wherein:

the hook includes a base end of substantially the same configuration as the transverse ends of the intermediate link members, and an extended end integrally formed with the base end; and the base end is operably connected to the belt.

10. An attachment mechanism as defined in claim 9 wherein:

the outer end of the belt defines a loop, and further comprising:

means for attaching the loop to the base end of the hook.

11. An attachment mechanism as defined in claim 9, further comprising:

a tab extending from the back side of the hook.

12. An attachment mechanism as defined in claim 11 wherein:

the cassette includes a recessed area adjacent to the receptacle to receive the hook when the belt and the intermediate link members are fully retracted within the receptacle.

13. An attachment mechanism as defined in claim 12 wherein:

the recessed area is adapted to receive the hook to position the back side of the hook flush with an outer surface of the cassette when the belt and the intermediate link members are fully retracted within the receptacle.

14. An attachment mechanism as defined in claim 13 wherein:

the tab extending from the back side of the hook engages the receptacle to releasably secure the hook in the recessed area.

15. An attachment mechanism adapted to attach an auxiliary luggage case to a main luggage case, comprising:

an elongated flexible belt having a plurality of restraints positioned incrementally along the length of the belt, the restraints comprising rectangularly shaped links having a pair of opposing transverse ends, each link defining a slot adjacent to each transverse end, and each slot having a width dimension sufficient to receive an end of the belt;

an attachment device attached to an outer end of the belt to connect the auxiliary luggage case to the belt;

an enclosure attached to the main luggage case comprising:

an elongated receptacle dimensioned to receive the belt and the restraints;

an edge of the receptacle, defining an opening through which the belt and restraints may be extended and retracted; and an inner end of the belt attached to the enclosure within the receptacle;

and wherein:

the belt is threaded through the slots to slidably secure the links along the length of the belt between the attachment device and the inner end of the belt and the transverse ends of adjacent links substantially abut one another;

the belt and the restraints are selectively extendable and retractable between a fully extended position outside the receptacle and a fully retracted position within the receptacle; and the retention structure is adapted to engage a selected one of the restraints and hold the belt and the attachment device in a position to receive the auxiliary luggage case once the belt is extended a predetermined length from the receptacle.

16. An attachment mechanism as defined in claim 15 wherein:

the enclosure is recessed within an outer surface of the main luggage case;

the enclosure defines a recessed area adapted to receive the attachment device; and the attachment device is flush with the outer surface of the main luggage case when the belt and the restraints are retracted within the receptacle and the attachment device is received in the recessed area.

17. An attachment mechanism as defined in claim 15 wherein:

the belt bends over the edge between adjacent restraints to maintain at least one restraint within the receptacle when the belt and the attachment device are extended to support the auxiliary case.

18. An attachment mechanism adapted to attach an auxiliary luggage case to a main luggage case, comprising:

an elongated flexible belt having a plurality of rectangularly shaped links positioned incrementally along the length of the belt;

the links having a front and back side, a pair of longitudinal sides, a pair of transverse ends, and a slot adjacent to each transverse end, each slot having a width dimension sufficient to receive an end of the belt;

an attachment device attached to an outer end of the belt to connect the auxiliary luggage case to the belt;

the belt being threaded through the slots to slidably secure the links along the length of the belt between the attachment device and an inner end of the belt;

the transverse ends of adjacent links substantially abutting one another;

a cassette attached to the main luggage case and defining a receptacle and a retention means adjacent to the receptacle, the receptacle having a length sufficient to receive the belt and the links; and the retention means is engageable with a selected link to hold the belt and the attachment device in the position established by the selected link.

19. An attachment mechanism as defined in claim 18 wherein:

the cassette is recessed within an outer surface of the main luggage case;

an outer surface of the cassette defines a recessed area having sufficient size to receive the attachment device; and the attachment device is flush with the outer surface of the main luggage case when received in the recessed area.

20. An attachment mechanism as defined in claim 19 wherein:

the cassette defines an opening through which the belt and the links are extended from and retracted within the receptacle;

the retention means includes an edge of the opening; and the belt bends toward the back side of the links over the edge between adjacent links and hangs adjacent to the outer surface of the cassette when prepared to support the auxiliary case.

* * * * *